United States Patent [19]

Frank et al.

[11] 4,046,469

[45] Sept. 6, 1977

[54] PHOTOCOPY MACHINE HAVING PHOTOELECTRIC PAPER CUT-OFF SENSOR

[75] Inventors: Thomas E. Frank; Roy E. Gum; J. T. Shoupe, all of Canton, Ohio; Dennis L. Warner, Baltimore, Md.

[73] Assignee: Graphic Enterprises, Canton, Ohio

[21] Appl. No.: 713,193

[22] Filed: Aug. 10, 1976

[51] Int. Cl.[2] ..... G03G 15/00

[52] U.S. Cl. ..... 355/13; 355/29; 355/51

[58] Field of Search ..... 355/27, 28, 29, 50, 355/51, 13, 10

[56] References Cited

U.S. PATENT DOCUMENTS

| | | | |
|---|---|---|---|
| 3,452,627 | 7/1969 | Goodman et al. | 355/29 |
| 3,672,762 | 6/1972 | Suzuki et al. | 355/10 |
| 3,706,490 | 12/1972 | Aasen et al. | 355/29 X |
| 3,797,346 | 3/1974 | Kakii et al. | 355/13 X |
| 3,806,241 | 4/1974 | Gregg et al. | 355/29 X |
| 3,865,481 | 2/1975 | Washio et al. | 355/29 X |
| 3,951,544 | 4/1976 | Mikasa | 355/29 |

*Primary Examiner*—Donald A. Griffin
*Attorney, Agent, or Firm*—Frease & Bishop

[57] ABSTRACT

A reciprocating carrier-type photocopy machine having a photoelectric sensor for controlling a copy paper cut-off knife, to conform automatically the size of the copy paper to the size of the original document. A light emitter and photoelectric sensor are mounted beneath a glass platen over which a carrier, which contains the original document, moves for exposing the document to the reproducing mechanism contained beneath. An elongated rectangular mirror is mounted on the bottom surface of the carrier lid for reflecting the emitted light back to the sensor. The original document, when placed in the carrier, blocks the emitted light from being reflected from the mirror to the sensor until the trailing edge of the document passes the emitted light. The reflected light, upon passage of the document, then actuates the photoelectric sensor, which in turn actuates a solenoid of a copy paper cut-off knife to sever the copy paper from its supply roll. The emitted light preferably is infrared and is modulated at a predetermined frequency to which the sensor is tuned to prevent premature actuation of the cut-off knife by an extraneous light source.

15 Claims, 11 Drawing Figures

PHOTOCOPY MACHINE HAVING PHOTOELECTRIC PAPER CUT-OFF SENSOR

BACKGROUND OF THE INVENTION

1. Field of the Invention

The invention relates to photocopy machines, and particularly to the type in which the original document is supported in a reciprocating carrier for moving the document through the exposure station. More particularly, the invention relates to a photoelectric paper cut-off sensor which detects automatically the size of the original and actuates a knife which cuts each copy to the exact size of the original, without being programmed manually by an operator.

2. Description of the Prior Art

Recent years have seen considerable advancement in xerography or document reproduction apparatus, commonly referred to as photocopy machines. These photocopy machines generally are of two main catagories depending upon the handling of the original document by the machine. In one type of photocopy machine the original is moved through the machine on a belt conveyor or roll mechanism in conjunction with a sheet or continuous web of copy paper through the exposure station. Such feedthrough machines possess the inherent danger of the original becoming stuck, lost or multilated within the machine, requiring partial machine disassembly to retrieve the same, as well as possible damage to the only available copy or valuable document.

Another type of photocopy machine uses a carrier for supporting the original document which in turn is reciprocated across the top of a housing during the exposure period. Many of these carrier-type photocopy machines use individual sheets of electrostatic copy paper stored in stack form within the machine, such as shown in U.S. Pat. Nos. 3,424,526, 3,604,796 and 3,672,762. Other carrier-type photocopy machines use a roll of continuous copy paper which moves through the machine in conjunction with the moving document carrier. A cut-off knife is mounted within these machines for severing of the continuous web of copy paper, depending upon the size of the original document.

The cut-off knife usually is controlled by a mechanically programmed or adjusted limit switch or the like which is set by the operator upon placing of the original in the carrier so that the copy paper is cut to the approximate length of the original to prevent waste. Examples of such machines are shown in U.S. Pat. Nos. 3,740,132 and 3,751,158.

Such manual setting usually positions a trip lever or the like which in turn contacts an electrical limit switch upon passage of the original to energize and actuate the cut-off knife. Problems occur in the operation of such machines, especially when the machines are used by inexperienced and a number of operators as in a large office. In such situations, the operator may not understand the mechanical setting procedure, and many times merely neglects to set the mechanical cut-off control. This results in excess copy paper, or faulty copies due to too short of copy paper.

Thus, the need has existed for a control mechanism which is of a relatively simple and inexpensive design for a photocopy machine which senses automatically the size of the original document and actuates the cut-off knife for the copy paper. No known mechanism or equipment of which we are aware uses a photoelectric sensor for this purpose in the particular manner set forth below for achieving these results.

Various photocopy machines use photoelectric sensors in the operation of the machine, but in a different manner than described below and set forth in the attached claims.

A photocopy machine described in U.S. Pat. Nos. 3,473,035 uses a plurality of photosensors in conjunction with openings in a document transport belt for sensing the size of the original to register the document correctly in the exposure zone, and not for actuation of a copy paper cut-off knife.

U.S. Pat. No. 3,536,401 discloses another photosensor mechanism in a photocopy machine in which the original is transported through the machine on a conveyor belt-type system in which the length of the original is sensed for actuation of the copy paper cut-off knife. The photosensor must be manually adjusted for the various lengths of originals so that the copy paper length corresponds to the length of the original and does not cut off the copy paper automatically to original documents of various lengths.

U.S. Pat. No. 3,689,143 discloses another photocopy machine which uses a plurality of photoelectric sensors which sense the width of the original document for selecting the proper size copy sheet for transporting to the exposure station from a plurality of stacks of copy sheets.

U.S. Pat. No. 3,879,125 discloses still another type photocopy machine using a plurality of photoelectric sensors for controlling the speed of travel of the original document and the copy paper based upon the position of the leading edge of the original which is sensed by the photosensors.

SUMMARY OF THE INVENTION

Objectives of the invention include providing a photocopy machine having a photoelectric paper cut-off sensor incorporated therein which automatically senses the length of the original document upon passage of the trailing edge to actuate a copy paper cut-off knife whereby the length of the copy paper matches the length of the original, preventing copy paper waste; providing such a photoelectric cut-off sensor which eliminates the necessity of an operator manually programming the machine for each different size of original document, thereby eliminating operator time and error, and enabling the photocopy machine to be operated easily by an inexperienced operator; providing such a photoelectric cut-off sensor for use on a "flat-bed" or movable carrier-type copier, enabling the use of continuous roll copying paper, eliminating the operator to utilize certain sizes of stacked copy paper as in some types of photocopy machines, and which cuts automatically each copy to the exact size of the original document; providing such a photoelectric control sensor which can be incorporated into most types of document carrier-type copiers at a minimum of cost and machine modification, and which can be included as an integral part of newly manufactured machines; providing such a sensor which utilizes an infrared light source for the sensing means, thereby reducing the possibility of premature actuation or non-actuation of the cut-off knife due to the extraneous light, or due to the accumulation of dust and dirt which could affect its operation, and in which the infrared light source is modulated at a predetermined frequency to which the photoelectric sensor is matched to prevent premature knife actuation even if exposed to a large source of infrared light; and providing such a photoelectric cut-off sensor which is of a relatively inexpensive and simple design, which eliminates difficulties heretofore encountered, achieves the stated objectives simply and effectively, and which solves problems and satisfies existing needs.

These objectives and advantages are obtained by the photocopy machine having a photoelectric paper cut-off sensor, the general nature of which may be stated as including a photocopy machine of the type having an original document carrier mounted for reciprocating movement on the top of a housing for moving the document across an external exposure station for reproduction of the document on a traveling web of copy paper fed from a supply roll of said paper located within the housing, said carrier having a lid and a transparent platen between which the document is placed; knife means for cutting the traveling web from the supply roll; and means controlling the reciprocating movement of the carrier and for controlling operation of the knife means; wherein the improvement includes, photoelectric means mounted beneath the transparent platen of the carrier rearwardly of the external exposure station and having light emitting means and light sensing means; a reflecting surface provided on the bottom of the carrier lid in alignment with the photoelectric means and adapted to pass over said photoelectric means upon forward movement of the carrier; electrical circuit means operatively connecting the photoelectric means with the knife means operating control means; the light emitting means being adapted to project a beam of light upwardly through the transparent platen of the carrier toward the carrier lid, with said light beam being blocked by a document in the carrier until passage of the trailing end of the document whereupon said light beam is reflected by the reflective surface of the lid and sensed by the light sensing means to actuate the knife means through the electrical circuit means to cut the traveling copy paper web to a length in direct relationship to the length of the original document; the light emitting means being a light emitting diode emitting a near infrared light beam, and the light sensing means being a silicon phototransistor; the light emitting means being modulated to a predetermined frequency with the light sensing means being adapted to be actuated by a predetermined frequency generally equal to the modulated frequency of the light emitting means; and the carrier lid reflective surface being an elongated mirror mounted on the bottom of the carrier lid and extending in the direction of carrier travel.

BRIEF DESCRIPTION OF THE DRAWINGS

A preferred embodiment of the invention — illustrative of the best mode in which applicants have contemplated applying the principles — is set forth in the following description and shown in the accompanying drawings, and is particularly and distinctly pointed out and set forth in the appended claims.

Similar numerals refer to similar parts throughout the drawings.

DESCRIPTION OF THE PREFERRED EMBODIMENT

Figure 1:
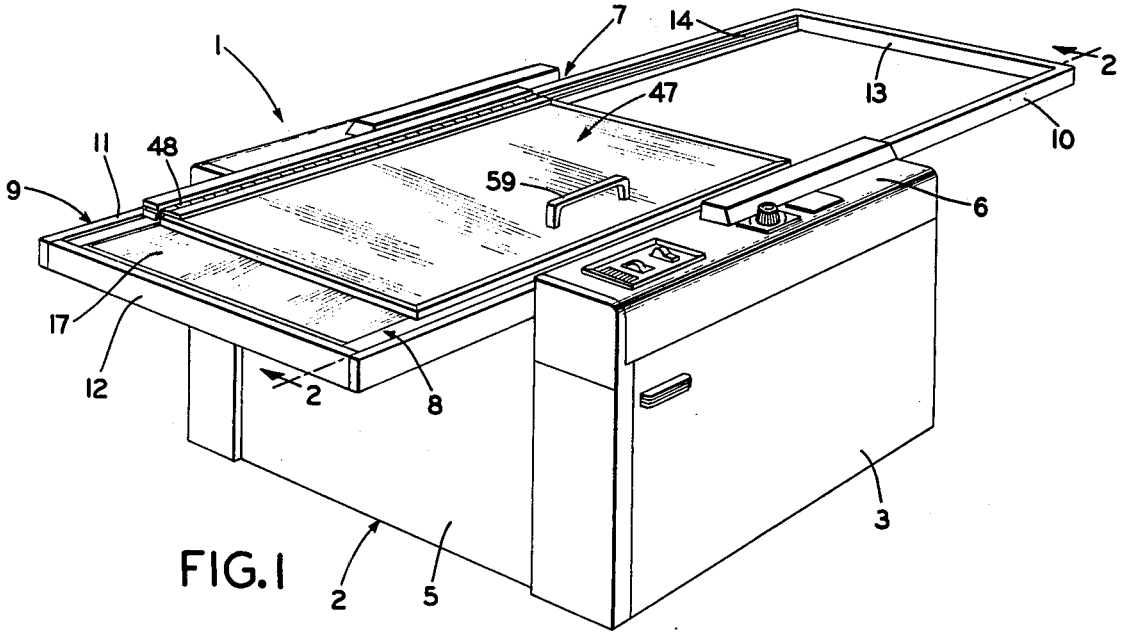
FIG. 1 is a perspective view of a type of photocopy machine in which the photoelectric paper cut-off sensor is incorporated.

A type of photocopy machine in which the photoelectric paper cut-off sensor mechanism is incorporated is shown particularly in FIG. 1 and is indicated generally at 1. Machine 1 has a generally rectangular housing 2 with vertical front and rear walls 3 and 4, and a pair of spaced vertical side walls 5. Many of the various switches and controls for operating machine 1 are mounted on a front control panel 6.

Arranged horizontally on the top of machine 1 is an original document carrier assembly, indicated generally at 7, having a carrier 8 reciprocally movable in a horizontally extending frame 9. Frame 9 is formed by a pair of spaced parallel, longitudinally extending members 10 and 11 and a pair of spaced parallel end members 12 and 13 extending transversely across the ends of members 10 and 11.

Figure 6:
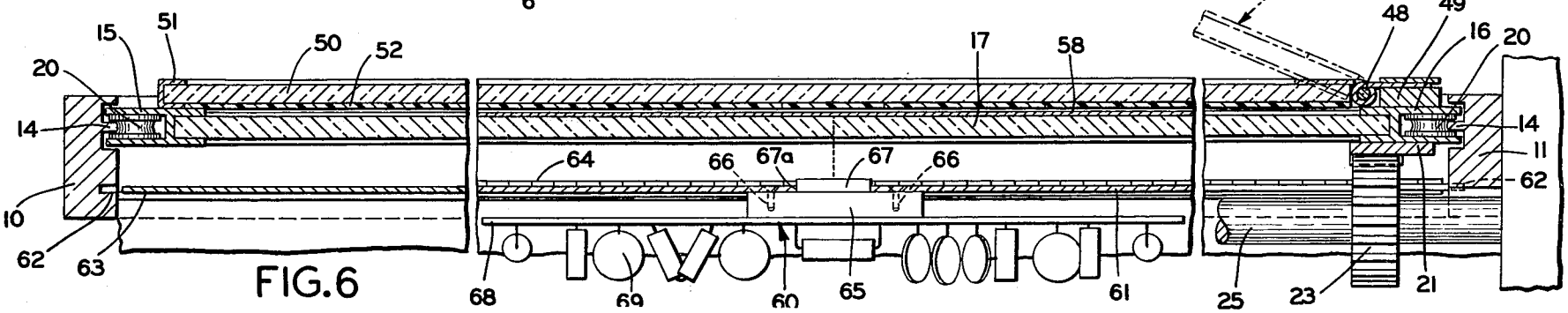
FIG. 6 is an enlarged fragmentary, sectional view taken on line 6—6, FIG. 5.

Carrier 8 includes a pair of H-shaped frame members 15 and 16 (FIG. 6) between which is mounted a transparent glass platen 17. U-shaped frame members 18 and 19 (FIG. 8) extend across and enclose the ends of glass platen 17. A plurality of grooved rollers 20 are fixed in spaced relationship along and within H-shaped frame members 15 and 16 for movably mounted carrier 8 on grooved channels 14 formed in frame members 10 and 11 (FIG. 6).

A gear rack 21 is mounted on the bottom of H-shaped frame member 16 (FIGS. 6 and 8) and extends longitudinally along rear wall 4 of machine 1 for engagement with forward and reverse carrier drive gears 22 and 23, respectively. Gears 22 and 23 are mounted on the ends of shafts 24 and 25, respectively, which shafts in turn are operatively engageable with suitable slip clutches and power drive means (not shown) located within housing 2.

The particular machine components described above are illustrative of one type of photocopier in which the photoelectric cut-off sensor may be incorporated and they may be modified without departing from the concept of the invention. The particular machine described is of the type sold by Oce-Industries Inc. of Chicago, Illinois, under Model No. SAC1245. Likewise, the photoelectric cut-off sensor to be described more fully below can be incorporated easily into the movable carrier-type machines such as shown in U.S. Pat. Nos. 3,697,165 and 3,751,158.

Figure 2:
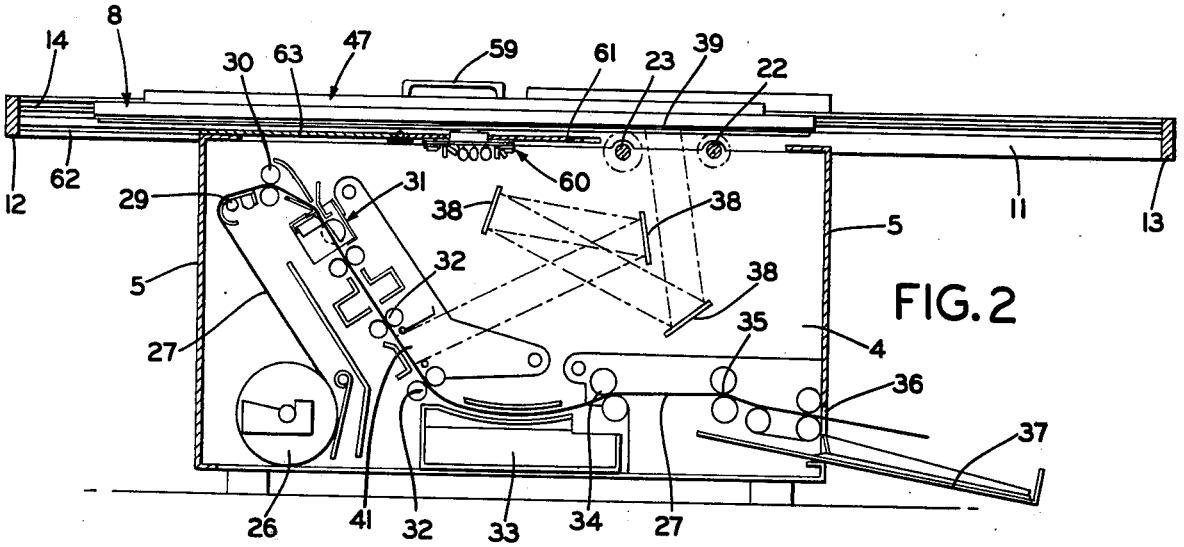
FIG. 2 is a generally diagrammatic vertical sectional view taken on line 2—2, FIG. 1.

Further details of the internal mechanism of machine 1 are shown in FIG. 2 and include a supply roll 26 of copy paper. A web 27 of copy paper extends upwardly past a brake 29, between a pair of feed rollers 30 and then downwardly through a cut-off knife mechanism, indicated generally at 31. Paper web 27 continues downwardly through multiple feed and guide roll pairs 32 and then through a developing tank 33. The web 27 passes between a pair of squeegee rollers 34 and then through a pair of blotter rollers 35 before passing through opening 36 in side wall 5 and into a copy collection tray 37.

Figure 5:
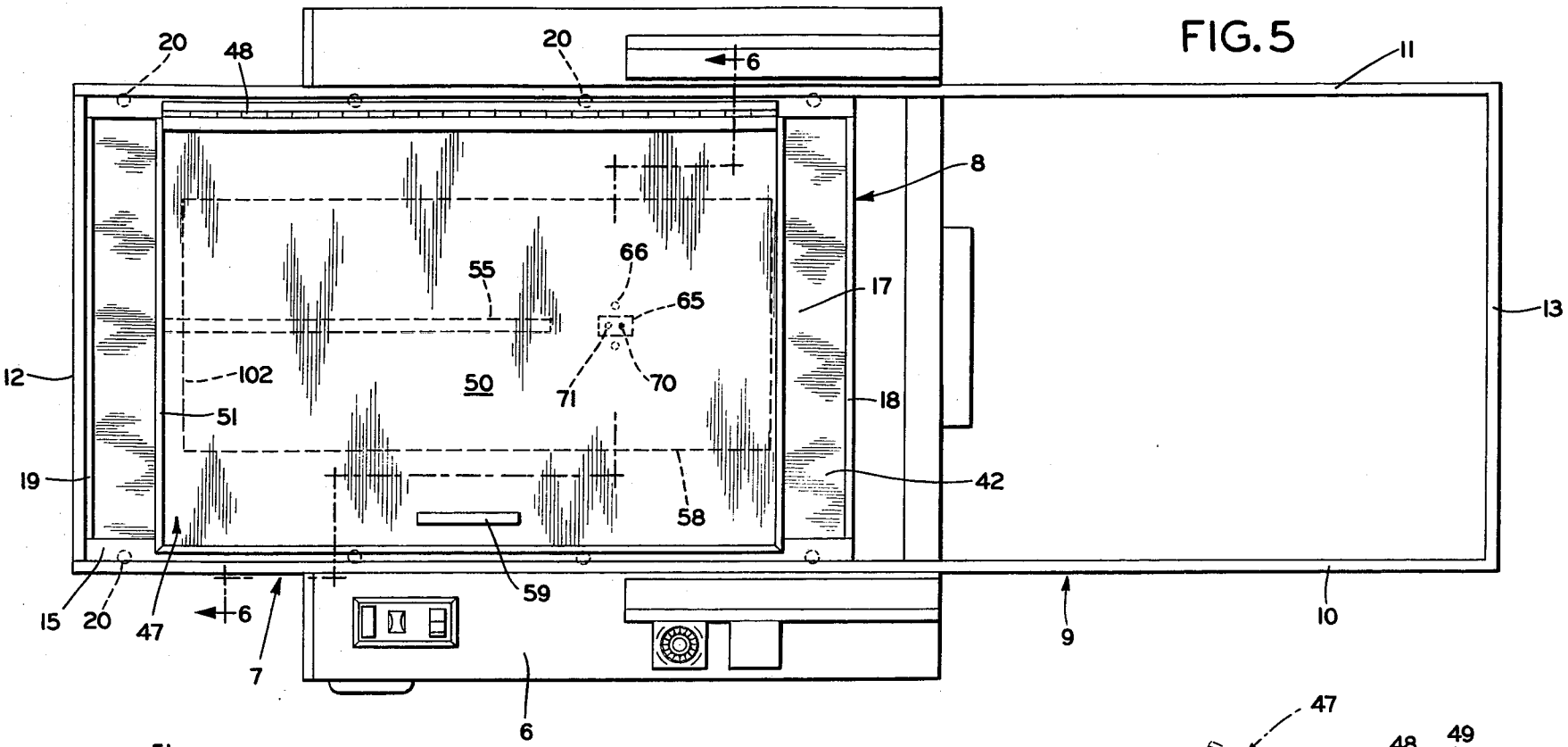
FIG. 5 is an enlarged top plan view of the photocopy machine of FIG. 1 with the original document carrier in home position.

A plurality of mirrors 38 are shown diagrammatically mounted in housing 2 forming the scanning or exposure area 39 over which the original document is moved by carrier 8. The internal exposure area 41 is located between the dot-dash lines of mirrors 38 and is located downstream of cut-off mechanism 31. The external exposure area is generally rectangular and occupying an area covered by a plate 42, as shown in FIG. 5. Internal exposure area 41 is similar in size to that of area 39.

Figure 3:
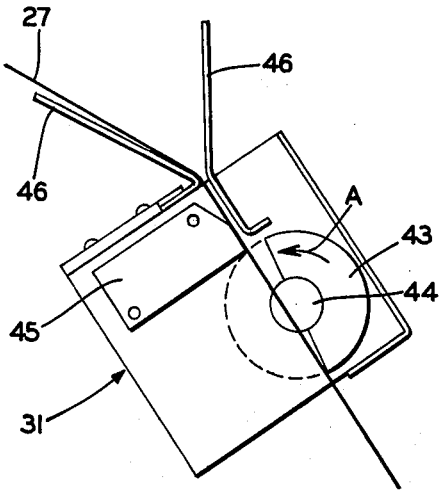
FIG. 3 is an enlarged fragmentary view of the copy paper cut-off knife mechanism.

Cut-off knife mechanism 31 is shown in greater detail in FIG. 3 and incudes a semi-circular knife blade 43 which is rotatably mounted on a shaft 44. Blade 43 severs traveling web 27 at the edge of a cutting block 45 when blade 43 and shaft 44 are rotated by an operating crankarm (not shown) upon actuation of a knife control solenoid. A pair of guide plates 46 properly position traveling web 27 between block 45 and blade 43.

Figure 7:
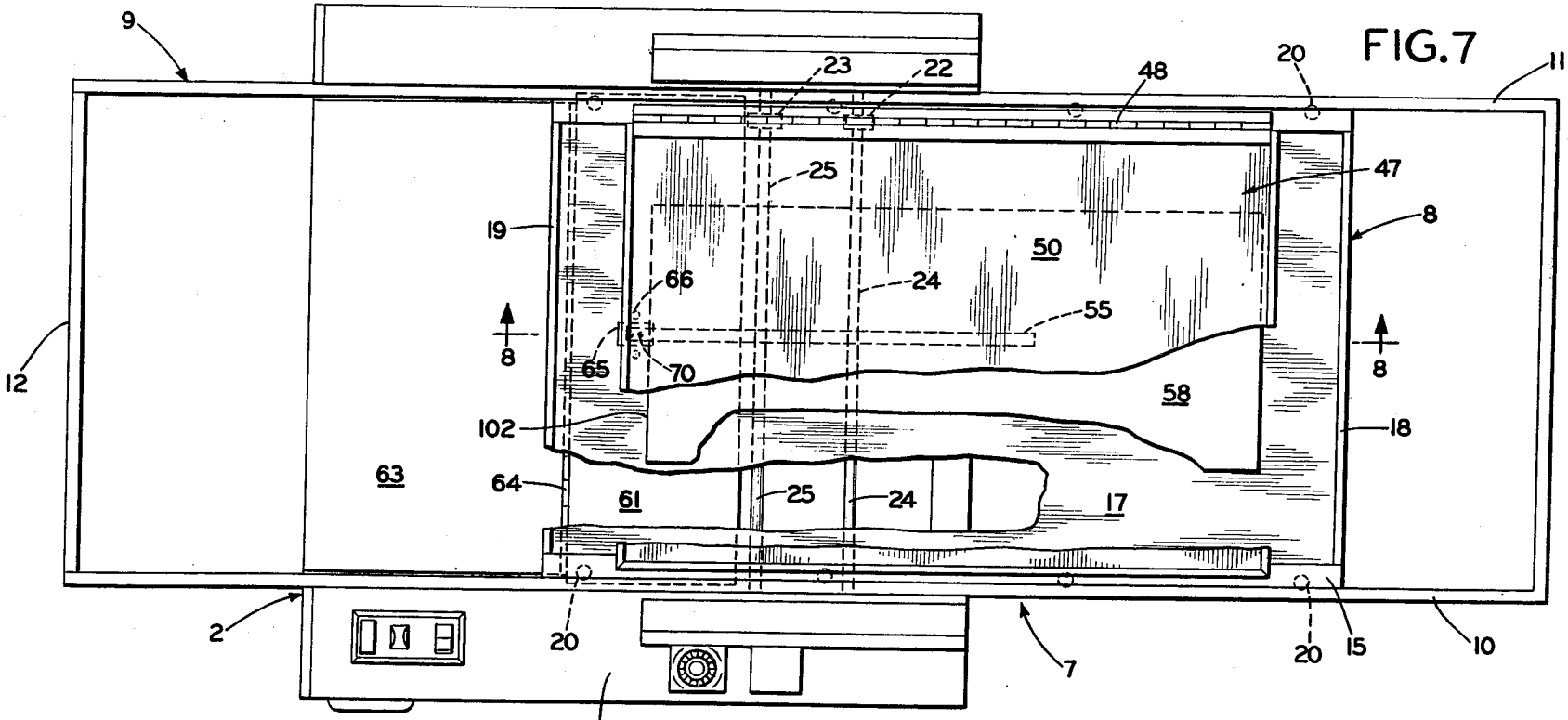
FIG. 7 is a top plan view similar to FIG. 5, with portions broken away, with the original document carrier in forward position.
Figure 8:
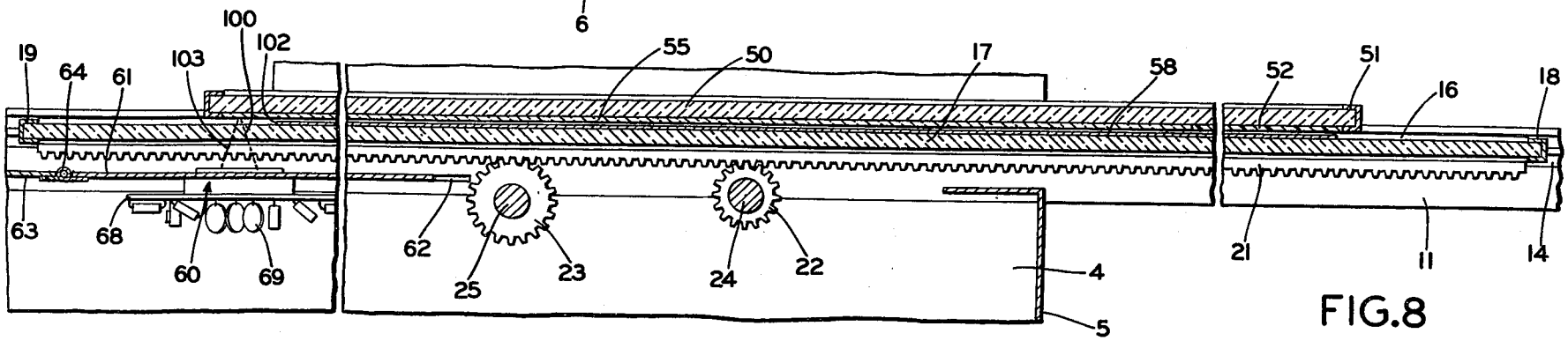
FIG. 8 is an enlarged fragmentary, sectional view taken on line 8—8, FIG. 7.

Carrier 8 moves reciprocally within frame 9 and is driven in a forward direction by drive gear 22 from its "home" position of FIG. 5 to a forward position of FIG. 7. Carrier 8 is returned from its forward position to its home position by gear 23. Gear 23 preferably is larger than gear 22, as shown in FIG. 8, so that carrier 8 travels faster towards its home position than towards its forward position.

Figure 4:
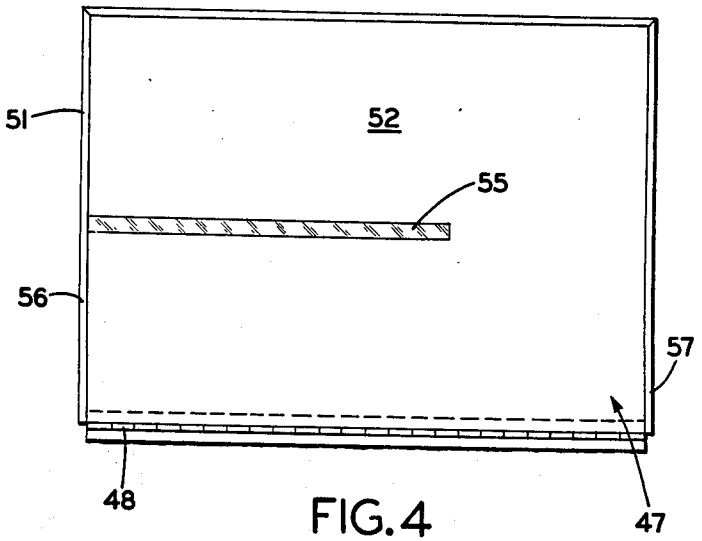
FIG. 4 is a fragmentary bottom plan view of the original document carrier lid showing the reflective mirror for actuation of the photoelectric sensor.

Carrier 8 includes a document cover lid 47 pivotally mounted by a hinge 48 to a longitudinally extending frame member 49, which in turn is mounted on H-shaped frame member 16 (FIGS. 5 and 6). Lid 47 includes a preferably rigid panel 50 mounted within a rectangular frame 51 formed by U-shaped channels. The bottom surface of lid panel 50 preferably is covered by a non-reflective rubberized material 52. In accordance with the invention, a narrow elongated mirror 55 is mounted on the bottom surface of lid 47 and extends longitudinally from the rear edge 56 of lid 47 toward the forward edge 57 thereof (FIG. 4).

Lid 47 is raised to an open position (dot-dash lines, FIG. 6) to permit the placement of an original document 58, desired to be reproduced, on glass platen 17. Lid 47 then is moved to its closed position (FIGS. 6 and 8) in juxtaposition with platen 17 retaining document 58 in reproducing position in carrier 8. A handle 59 is provided on the swinging end of lid 47 to permit the raising and lowering of the lid.

In further accordance with the invention, a photoelectric copy paper cut-off sensor unit, indicated generally at 60 is mounted beneath platen 17 for automatically controlling the operation of the operating solenoid of knife blade 43. Sensor unit 60 includes a rigid mounting plate 61 which preferably has a non-reflective black top surface. Plate 61 extends transversely across frame 9 and is slidably mounted on and received within grooves 62 (FIGS. 6 and 7), formed in frame members 10 and 11. A door 63 may be pivotally mounted by a hinge 64 on the rear end of plate 61 to form a cover for an access opening to the machine components located within housing 2.

A photocell mounting block 65 is attached by screws 66 centrally on plate 61. Block 65 includes a rectangular top portion 67 which extends through a complementary opening **67*a* formed in plate 61. A circuit board 68 is attached to the bottom of mounting block 65 on which various electric components are mounted, which components are indicated at 69 and shown diagrammatically in FIGS. 2 and 6. A light emitter 70 and a photoelectric sensor 71 are mounted in block portion 67 and are located beneath platen 17 and in alignment with the longitudinally extending path over which lid mirror 55 travels during the reciprocal movement of carrier 8**.

Figure 9A:
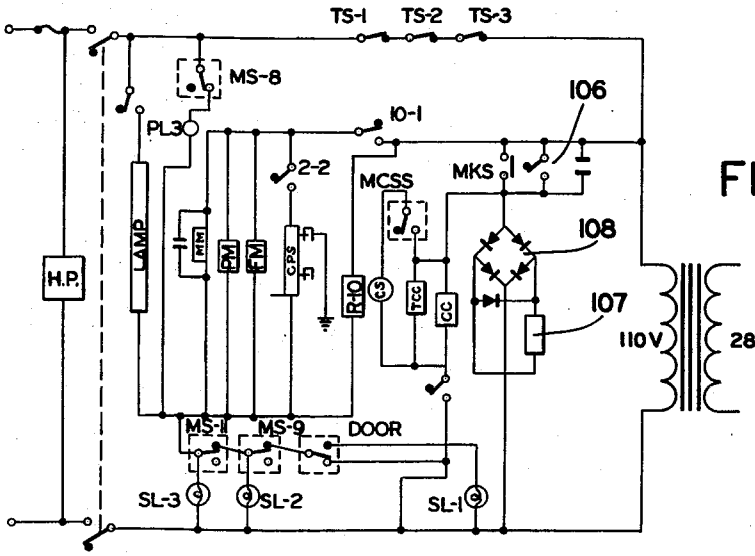
FIGS. 9A and 9B are electrical schematic diagrams of a type of electrical control for the photocopy machine of FIG. 1, having the photoelectric cut-off sensor incorporated therein.
Figure 9B:
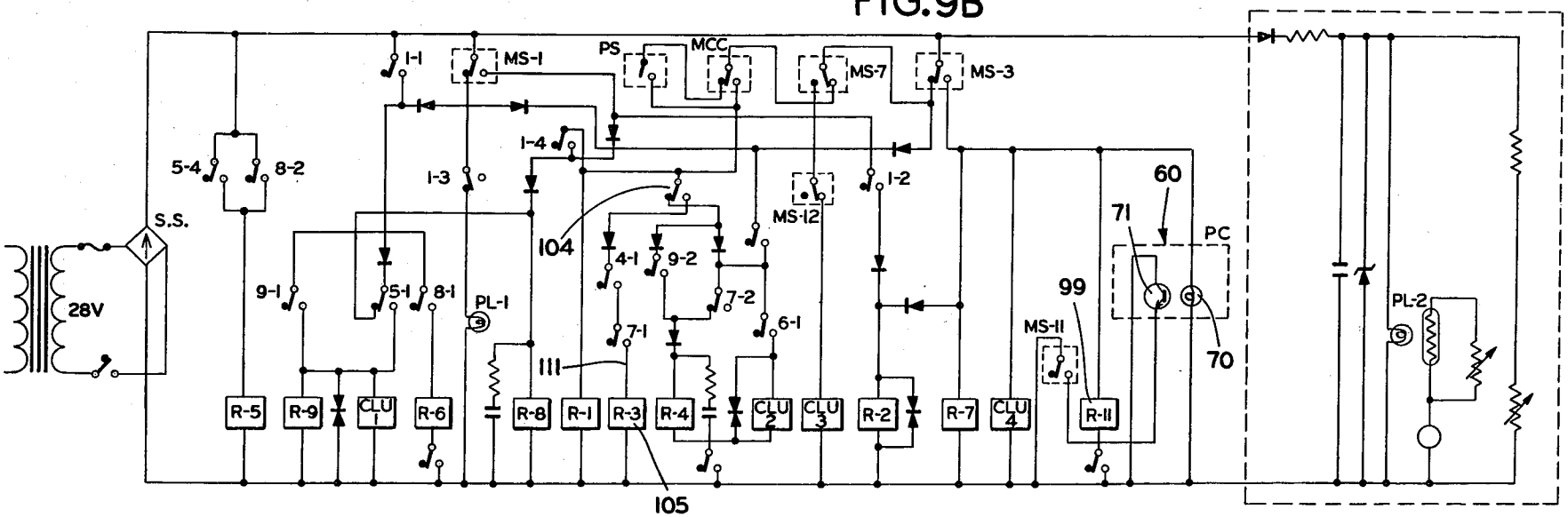
Figure 10:
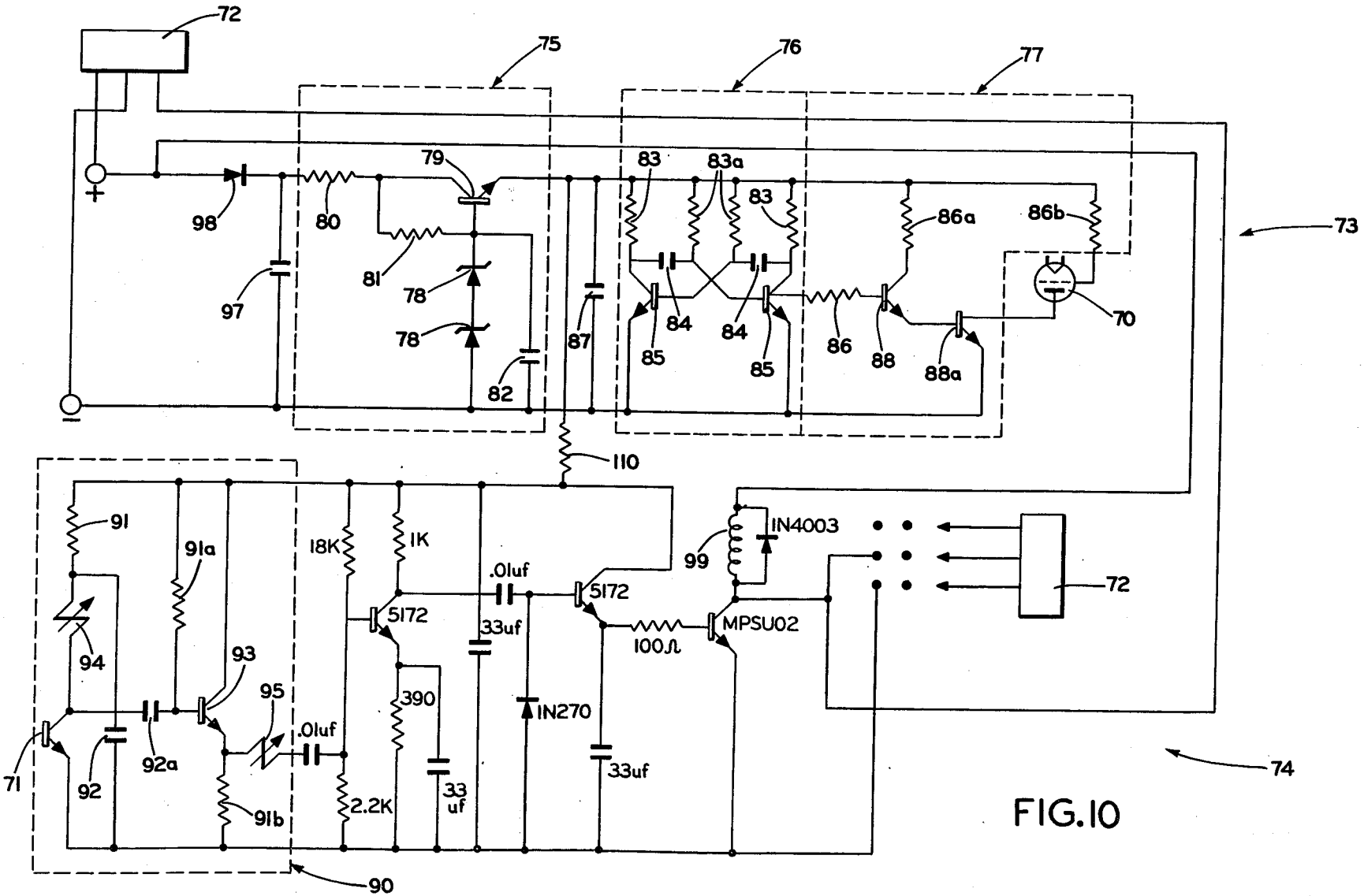
FIG. 10 is a detailed electrical schematic diagram of the photoelectric sensor and paper cut-off knife control circuit.

An electrical schematic diagram for photoelectric sensor unit 60 is shown in FIG. 10 and includes a pair of connection blocks 72 for mechanically and electrically connecting the sensor unit to the electrical system of machine 1, shown schematically in FIGS. 9A and 9B. The sensor circuitry includes a light emitting portion 73 and a light sensing portion 74, generally forming the upper and lower circuit portions, respectively, of FIG. 10.

Lighting emitting circuit portion 73 includes generally three subcircuits enclosed within the dash lines of FIG. 10 which are indicated generally at 75, 76 and 77. Subcircuit 75 provides a voltage regulation function and steps down the supply voltage (for example 24 volts to 8 volts), and maintains this voltage constant despite minor fluctuations in the supply voltage. Subcircuit 75 includes a pair of zener diodes 78, a transistor 79, resistors 80 and 81, and a capacitor 82. A stabilizing capacitor 97 and diode 98 are connected in the circuit between the input terminals and subcircuit 75.

Subcircuit 76 provides the circuitry portion for modulating the emitted light of emitter 70 at a predetermined frequency (for example at 33,000 cps). Modulating subcircuit 76 includes a resistor-capacitor network having a plurality of resistors 83 and **83*a*, a pair of capacitors 84, and a pair of transistors 85. The value of capacitors 84 determines the speed of modulation of light emitter 70. A capacitor 87 is interposed between subcircuit 75 and 76** as shown.

Subcircuit 77 reduces the voltage supplied to modulating subcircuit 76 (8 volts) down to the acceptable voltage rating of light emitter 70 (for example 0.5 volts to 1.2 volts). Subcircuit 77 includes a plurality of resistors 86, **86*a* and 86*b* and a pair of transistors 88 and 88*a*. Light emitter 70 preferably is an infrared light emitting diode, type T1L 32**, which when forward biased, emits near infrared light.

Light sensing circuit portion 74 is connected to light emitting circuit portion 73 by a resistor 110. Circuit portion 74 includes a subcircuit 90, located within the dash rectangular lines, which regulates the amount of light required to actuate photoelectric sensor 71. Subcircuit 90 includes photoelectric sensor 71 which may be a silicon photo transistor (type FPT 100), commonly referred to as a photocell, and a plurality of interconnected resistors 91, **91*a* and 91*b*, capacitors 92 and 92*a*, a transistor 93 and a pair of potentiometers 94 and 95. Potentiometers 94 and 95 provide the fine and course adjustments, respectively, for calibrating photoelectric sensor 71**.

The remaining portion of circuit 74 includes the various resistors, capacitors and transistors, shown in FIG. 10, which primarily amplify the voltage supplied to relay coil 99. The various values shown in FIG. 10 for these remaining components are those which are compatible with the values and components set forth in the following table. This circuitry is not discussed in detail since it is a common type of amplifying circuit.

The following table gives an example of the values for the components of sensor unit 60, shown in FIG. 10.

| Designation No. | Description |
|---|---|
| 70 | T1L 32 |
| 71 | FPT 100 |
| 78 | 1 amp |
| 79 | MP5U02 |
| 80 | 50 ohms |
| 81 | 390 ohms |
| 82 | 33 uf |
| 83 | 1K ohms |
| 83a | 18K ohms |
| 84 | .003 uf |
| 85 | 5172 |
| 86 | 18K ohms |
| 86a | 1K ohms |
| 86b | 100 ohms |
| 87 | 33 uf |
| 88 | 5172 |
| 88a | MPSU02 |
| 91 | 1K ohms |
| 91a | 100 ohms |
| 91b | 100 ohms |
| 92 | 33 uf |
| 92a | .01 uf |
| 93 | 5172 |
| 94 | 10K ohms |
| 95 | 10K ohms |
| 97 | 33 uf |
| 98 | 1N4003 |
| 110 | 100 ohms |

In operation, light emitting diode 70 emits a modulated beam of infrared light 100 (FIG. 8) upwardly toward carrier 8 through transparent glass platen 17. Upon passage of the trailing edge 102 of document 58, light beam 100 is reflected by mirror 55 downwardly as a reflected modulated infrared beam 103 and is sensed by photoelectric sensor 71. Reflected beam 103 actuates photo sensor 71 which in turn energizes relay coil 99 through circuit portion 74 of FIG. 10. Energized coil 99 moves its relay contact 104 (FIG. 9B) from a normally closed position, as shown, to open position. This completes the circuit through line 111 due to the previous closing of the other two relays in line 111 by other machine operations unrelated to the operation of the cut-off sensor, and energizes coil 105. Energized coil 105 closes its associated contact 106 (FIG. 9A), which in turn energizes knife blade solenoid 107 through diode network 108, which changes the 110 volts AC to the desired DC solenoid voltage. Knife blade solenoid 107, upon being energized, rotates knife blade 43 in the direction of arrow A (FIG. 3) severing the moving web 27 of copy paper.

The remaining components of FIGS. 9A and 9B and the functions thereof pertain to the operation of machine 1 and are not pertinent to the photoelectric paper cut-off sensor except as discussed above. Therefore these features are not discussed in detail, but are set forth in the following table for illustration purposes. These features and circuits may change without affecting the invention depending upon the particular carrier-type photocopy machine in which the cut-off sensor is incorporated.

| SYMBOL | DESCRIPTION |
|---|---|
| PL-1 | FEED LAMP |
| PL-2 | DENSITY METER LAMP |
| PL-3 | PRINT SWITCH LAMP |
| M.M. | MAIN MOTOR |

-continued

| SYMBOL | DESCRIPTION |
|---|---|
| P.M. | PUMP MOTOR |
| F.M. | FAN MOTOR |
| C.P.S. | CORONA POWER SUPPLY |
| C.C. | COPY COUNTER |
| M.C.C. | MULTIPLE COPY COUNTER SWITCH |
| M.C.S.S. | MULTIPLE COPY SETTER SWITCH |
| T.C.C. | TOTAL COPY COUNTER |
| M.K.S. | MANUAL KNIFE SWITCH |
| RO-11 | KNIFE (KNIFE RELAY) |
| LAMP | EXPOSURE LAMP |
| SL-1 | DOOR AJAR LAMP |
| SL-2 | PLATEN SAFETY LAMP |
| SL-3 | JAM DETECTOR LAMP |
| MS-1 | COPY READY SWITCH |
| MS-3 | EXPOSURE HOLD, CL-3, CLU-4, AND PHOTOCELL SWITCH |
| MS-7 | PLATEN REVERSE |
| MS-8 | PRINT LAMP SWITCH |
| MS-9 | PLATEN SAFETY SWITCH |
| MS-10 | 24" MANUAL CUT |
| MS-11 | JAM SWITCH |
| MS-12 | LID SWITCH |
| S.S. | RECTIFIER |
| CLU-1 | CORONA INPUT CLUTCH |
| CLU-2 | ROLL PAPER FEED CLUTCH |
| CLU-3 | PLATEN REVERSE CLUTCH |
| CLU-4 | PLATEN FORWARD CLUTCH |
| TS-1 | THERMAL SWITCH, MAIN MOTOR |
| TS14 2 | THERMAL SWITCH, FAN MOTOR |
| TS-3 | THERMAL SWITCH, FAN MOTOR |
| P.C. | PHOTOCELL BOARD |
| P.S. | PRINT SWITCH |
| CS | M.C.C. SOLENOID |
| HP | HEATING PAD |

Light emitting diode 70 and 71 are positioned rearwardly from external exposure area or station 39 (FIG. 2) a distance equal to the physical separation of cut-off knife assembly 31 from internal exposure area or station 41. Therefore, immediately upon passage of trailing end 102 of document 58 beyond infrared beam 100 and actuation of knife assembly 31 to sever copy web 27, the proper amount of unexposed copy paper remains between knife assembly 31 and exposure area 41 which is equal to the remaining amount of unexposed document.

Sensor unit 60 is adjustable with respect to external exposure station 39 by moving plate 61 longitudinally within grooves 62. This adjustment provides for minor variations and operating characteristics in each machine to insure exact matching of the copy size to the original document. Once such adjustment is made for a particular photocopy machine, seldom will further adjustments ever be required, regardless of the various sizes of original documents, as in prior machines.

Use of an infrared light beam instead of a usual "white" light beam reduces possible malfunction of the sensing equipment due to the accumulation of dust and dirt which has a greater effect on "white" light than on infrared light. Likewise, the modulation of the light beam and photoelectric sensor reduces the possibility of a malfunction by an extraneous light source or from the developing lamps within the machine, all of which contain some infrared light components.

Although the sensing light source is described as being a modulated infrared light, it is easily seen that the use of an unmodulated white light source will enable the features of the photoelectric paper cut-off sensor to be achieved. Also, the particular machine components' circuitry and operation, described above, may be varied somewhat, depending upon the type of carrier photocopy machine in which the sensor is incorporated, without affecting the features of the invention.

Simplicity, convenience and efficiency are enhanced further by the structural arrangement of the wiring and components of the sensing device on a readily removable and accessible board and mounting panel which is located completely within the interior of the photocopy machine housing. Thus, no components project from the machine which are accessible to the operator to become damaged or broken.

Economics are achieved in that the sensor may be adapted to and incorporated in existing photocopy machines. Likewise, only minor structural and electrical modifications and production changes in the manufacture of new photocopy machines are involved.

Accordingly, the photoelectric paper cut-off sensor is simplified, provides an effective, safe, inexpensive and efficient device which achieves all the enumerated objectives, provides for eliminating difficulties encountered with prior photocopy machines, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the photocopy machine having photoelectric paper cut-off sensor is constructed and used, the characteristics of the construction, and the advantageous, new and useful results obtained; the new and useful structures, devices, elements, arrangements, parts, and combinations, are set forth in the appended claims.

We claim:

1. A photocopy machine of the type having an original document carrier mounted for reciprocating movement on the top of a housing for moving the document across an external exposure station for reproduction of the document on a traveling web of copy paper fed from a supply roll of said paper located within the housing, said carrier having a lid and a transparent platen between which the document is placed; knife means for cutting the traveling web from the supply roll; and means controlling the reciprocating movement of the carrier and for controlling operation of the knife means; the improvement including:

a. photoelectric means mounted beneath the transparent platen of the carrier rearwardly of the external exposure station and having light emitting means and light sensing means;

b. a reflecting surface provided on the bottom of the carrier lid in alignment with the photoelectric means and adapted to pass over said photoelectric means upon forward movement of the carrier;

c. electrical circuit means operatively connecting the photoelectric means with the knife means operating control means; and d. the light emitting means adapted to project a beam of light upwardly through the transparent platen of the carrier toward the carrier lid, with said light beam being blocked by a document in the carrier until passage of the trailing end of the document whereupon said light beam is reflected by the reflective surface of the lid and sensed by the light sensing means to actuate the knife means through the electrical circuit means to cut the traveling copy paper web to a length in direct relationship to the length of the original document.

2. The photocopy machine defined in claim 1 in which the light emitting means is a near infrared light emitter; and in which the light sensing means is responsive to infrared light.

3. The photocopy machine defined in claim 2 in which the light emitting means is a light emitting diode; and in which the light sensing means is a silicon phototransistor.

4. The photocopy machine defined in claim 1 in which the light emitting means is modulated to a predetermined frequency; and in which the light sensing means is adapted to be actuated by a predetermined frequency generally equal to the modulated frequency of the light emitting means.

5. The photocopy machine defined in claim 1 in which the carrier lid reflective surface is an elongated mirror mounted on the bottom of the carrier lid extending in the direction of carrier travel.

6. The photocopy machine defined in claim 1 in which the photoelectric means is mounted on a panel; and in which said panel is movably mounted beneath the document carrier for adjustment along the path of carrier travel.

7. The photocopy machine defined in claim 6 in which frame means are mounted on and extend longitudinally along the top of the housing; in which the carrier is movably mounted in the frame means; in which groove means are formed in the frame means; and in which the photoelectric means mounting panel is slidably received in the groove means for adjustably positioning the photoelectric means along the path of carrier travel.

8. The photocopy machine defined in claim 1 in which an internal exposure station is located within the housing; and in which the knife means is located upstream of the internal exposure station with respect to the traveling web a distance generally equal to the distance that the photoelectric means is located rearwardly of the external exposure station.

9. The photocopy machine defined in claim 1 in which the knife means has a cutting blade and a solenoid controlling operation of said cutting blade; and in which the light sensing means, upon sensing the reflected light beam, actuates the cutting blade solenoid to cut the traveling web of copy paper from the supply roll.

10. A photoelectric paper cut-off sensor for a photocopy machine of the type having an original document carrier mounted for reciprocating movement on the top of a housing for moving the document across an external exposure station for reproduction of the document on a traveling web of copy paper supplied from a roll of said paper located within the housing, and means for severing the traveling web of copy paper from the roll, wherein the improvement includes:

a. light emitting means and light sensing means mounted in close priximity to each other beneath the document carrier rearwardly of the external exposure station;

b. reflecting means mounted above the light emitting means and light sensing means, with a document being movable by the carrier between said light emitting and sensing means and the reflecting means;

c. the light emitting means being adapted to project a light beam upwardly toward the reflecting means, with the light sensing means sensing said light beam when reflected by the reflecting means; and d. means operatively connected between the light sensing means and copy paper severig means for actuating said severing means upon the light sensing means sensing the reflected light beam, whereby a document in the carrier blocks the light beam from the reflecting means until passage of the document trailing edge, whereupon the light beam is reflected by the reflecting means to the light sensing means to actuate the copy paper severing means.

11. The photoelectric paper cut-off sensor defined in claim 10 in which the photocopy machine carrier has a transparent platen and a pivotally mounted lid; in which a document, when transported by the carrier, is placed between the platen and lid; and in which the reflecting means is mounted on the bottom of the lid.

12. The photoelectric paper cut-off sensor defined in claim 11 in which the reflecting means is an elongated mirror mounted on the bottom of the lid; and in which said mirror extends longitudinally along the lid in the direction of travel of the carrier from adjacent the rear edge of the lid.

13. The photoelectric paper cut-off sensor defined in claim 10 in which the light emitting means emits an infrared light beam; in which means is operatively connected to the light emitting means for modulating the emitted infrared light beam; and in which the light sensing means is responsive only to a modulated light beam having the same frequency as the emitted light beam.

14. A photoelectric paper cut-off sensor defined in claim 10 in which the light emitting and sensing means are mounted on a panel; and in which said panel is adjustably mounted beneath the document carrier.

15. The photoelectric paper cut-off sensor defined in claim 10 in which an internal exposure station is located within the housing of the photocopy machine; and in which the severing means includes a knife blade located upstream of the internal exposure station with respect to the traveling web, a distance generally equal to the distance that the light emitting and sensing means are located rearwardly of the external exposure station.

* * * * *